US007789519B2

(12) United States Patent
Gietl et al.

(10) Patent No.: US 7,789,519 B2
(45) Date of Patent: Sep. 7, 2010

(54) ILLUMINATED DISPLAY WINDOW FOR LED AND/OR LC DISPLAYS

(75) Inventors: Günter Gietl, Neustadt (DE); Erwin Helbrecht, Wenzenbach (DE); Herbert Kleinlein, Oberasbach (DE); Lothar Knopp, Berlin (DE); Thomas Ludenia, Falkensee (DE); Gerhard Mager, Cadolzburg (DE); Peter Vogelsang, Regensburg (DE)

(73) Assignee: BSH Bosch uns Siemens Hausgeraete GmbH, Munich (DE)

( * ) Notice: Subject to any disclaimer, the term of this patent is extended or adjusted under 35 U.S.C. 154(b) by 81 days.

(21) Appl. No.: 11/909,485

(22) PCT Filed: Feb. 16, 2006

(86) PCT No.: PCT/EP2006/060026

§ 371 (c)(1),
(2), (4) Date: Dec. 6, 2007

(87) PCT Pub. No.: WO2006/100160

PCT Pub. Date: Sep. 28, 2006

(65) Prior Publication Data

US 2009/0129057 A1 May 21, 2009

(30) Foreign Application Priority Data

Mar. 24, 2005 (DE) ..... 10 2005 013 804

(51) Int. Cl.
*F21V 33/00* (2006.01)

(52) U.S. Cl. ..... 362/97.3; 362/27; 362/241

(58) Field of Classification Search ..... 362/26, 362/27, 85, 97.2, 97.3, 97.4, 241, 242, 244, 362/602, 604

See application file for complete search history.

(56) References Cited

U.S. PATENT DOCUMENTS

| | | | | |
|---|---|---|---|---|
| 2,953,668 | A * | 9/1960 | Bassett, Jr. | 362/27 |
| 3,131,670 | A * | 5/1964 | Hardesty | 362/27 |
| 4,247,747 | A * | 1/1981 | Swatten | 362/23 |
| 5,975,711 | A * | 11/1999 | Parker et al. | 362/27 |
| 6,601,961 | B1 * | 8/2003 | Masaki | 362/26 |
| 7,207,686 | B2 * | 4/2007 | Schmidt et al. | 362/26 |
| 7,374,323 | B1 * | 5/2008 | Kelman et al. | 362/27 |

* cited by examiner

*Primary Examiner*—Y My Quach Lee
(74) *Attorney, Agent, or Firm*—Laurence A. Greenberg; Werner H. Stemer; Ralph E. Locher

(57) ABSTRACT

A display window is particularly suited for LED and/or LC displays. The display window includes a lighting device and a microstructure for illuminating the display window. The microstructure is disposed on the side of the display window facing the display.

12 Claims, 7 Drawing Sheets

ILLUMINATED DISPLAY WINDOW FOR LED AND/OR LC DISPLAYS

BACKGROUND OF THE INVENTION

Field of the Invention

The invention relates to a display window, in particular for LED (light emitting diode) and LC (liquid crystal) displays, with a lighting device and a microstructure for illuminating the display window.

Known from DE 20 2004 001 911 U1 is an LED display with a light-guide plate disposed in front thereof. The light-guide plate which can be illuminated with a projection light source is hereby intended to provide a light screening effect for the LED display. To ensure that the light from the projection light source can be reflected and concentrated as completely as possible, a light-guiding configuration is provided. This configuration is disposed on the surface of the light-guide plate facing the viewer. Since the light-guide plate occludes the display from the exterior, the configuration is exposed to all external influences without protection. A further drawback hereby is the fact that the uneven surface of the light guide plate due to the configuration offers a good resting place for contaminants such as, for example, dust. The contaminants or even damage, such as scratches for example, can have a negative impact on or even entirely impede the light-guiding function of the configuration.

SUMMARY OF THE INVENTION

Therefore, the object underlying the invention is to provide a display window, in particular for LED and LC displays, which protects the displays and ensures consistently good foreground illumination for the displays with simultaneously good legibility of the display information.

This object is achieved by a display window, in particular for LED and LC displays, with a lighting device and a microstructure for illuminating the display window in which the microstructure is disposed on the side of the display window facing the display.

According to the invention, a differentiation is made between a front side and a rear side of the display window. The side of the display window facing the viewer hereby represents the front side and the side facing the display represents the rear side of the display window. Generally, the front side and rear side are disposed in parallel to one another. In deviation from this, a non-parallel disposition of the front side and rear side in relation to one another may be necessary for structural reasons depending upon the design of the display unit.

The microstructure ensures the decoupling of the light energy coupled into the display window by the lighting device, for example laterally coupled-in light energy on the front side of the display window. This enables the entire display window to be illuminated in a targeted way. Due to its disposition according to the invention on the rear side of the display window, the microstructure lies within the interior of the display unit. This disposition protects the microstructure from adverse external influences and in this way guarantees permanently good legibility of the display information. For example, in this way, no dust particles are able to settle on the microstructure. Other influences such as chemical cleaning agents or damage due to mechanical impacts—for example scratches—are unable to damage the microstructure and impair its function.

The microstructure therefore fulfils a dual function: on the one hand, it emits light, which is irradiated laterally into the display window, toward the front side of the display window and hence against the direction of view of the user and on the other, it enables a user to view the display in a direction perpendicular to the plane of the display window. For this, the microstructure can comprise surfaces which reflect the light coupled into the display window by the lighting device perpendicular to the surface or front side of the display window. Hereby, the surfaces can be disposed at angles and/or be flat, concave or convex. Hereby, the geometric shape of the surfaces can in principle be freely selected as long as it results in substantially perpendicular radiation. The perpendicular radiation of the coupled-in light produces the most intensive light impression for the viewer and consequently offers the most efficient use of the coupled-in light energy.

In order to meet both aforementioned functions of the microstructure, in a first embodiment, the surfaces can completely cover the display window and be only partially reflecting or translucent enough for the display information to remain identifiable through them. According to another embodiment, the surfaces can be embodied as completely reflecting but then they will not occupy the entire area of the display window. Instead, they have free intervals between each other through which the display information remains identifiable. The miniaturized design and the uniform distribution of the surfaces in the microstructure mean the user still receives a homogeneous impression.

The microstructure can also be embodied within the display window in the form of microparticles with reflecting surfaces with an alignment suitable for perpendicular light reflection. The alignment of the microparticles can, for example, take place by means of a magnetic field during the process of the production of the display window, wherein, for example, metal powder is added to the actual microparticles. A very fine distribution of the microparticles achieves a two-dimensional and homogeneous decoupling of the light energy.

According to the invention, a differentiation is made between lighting devices for illuminating the display window on the one hand and display LEDs or display LC cells for representing the display information on the other.

It is also possible to use LEDs as lighting devices. LEDs of this kind can in principle be all LEDs known to the person skilled in the art suitable for illuminating the display window. For example, it is possible to use SMD (surface mounted device) LEDs which are placed on the same board as that bearing the display LEDs. The display LEDs can also have an SMD design. The board can, for example, be a PCB (printed circuit board).

The lighting devices in the form of LEDs can, for example, be integrated in the display window, adjoin the side of the display window and/or also be disposed remotely from the display window. In particular with a disposition of the lighting devices remotely from the display window, according to a further advantageous embodiment of the invention, optical links can be disposed between the lighting devices and the display window. The optical links conduct the light energy from the lighting device to the visible area of the display window. The optical links can be part of the display window. They can be disposed in the plane of the display window or at an angle thereto.

According to the invention, the display window can comprise a film or an inscription. The film or inscription can preferably—protected against external influences—be disposed on the rear side of the display window and, to define regions of the of the display window, cover it partially or completely. This can involve both regions for representing display information and regions in which no display information is represented. In the case of opaque films or inscriptions, regions of the display window without display information can be covered so that they appear dark to the viewer. The regions with display information can then be embodied either with transparent film or without an inscription. This enables demarcation or better contrast with illuminated regions with display information. Alternatively, the display window can comprise a film or an inscription in some regions only. In this way, the light energy reflected by means of the microstructure can be made visible in the form of foreground illumination in precisely defined regions of the microstructure.

A further possibility for representing the display information is provided by a negative inscription or negative representation of the display information applied to the display window on a film or on the display window. Hereby, the display information—for example in the form of text and/or symbols—appears to be translucent to the viewer on illumination. The regions without display information can hereby be inscribed opaquely or covered with opaque film.

According to the invention, the film can be diffuse. A diffuse film causes display information represented by several individual LEDs to appear homogeneous to the viewers, since they are no longer able to perceive separate LEDs through the diffuse film. This effect can be assisted by a certain distance between the display LEDs and the display window.

The display window can be completely or partially colored so that regions of the display window appear to be differently colored. This can improve the assignment or recognition of certain regions for the viewer. For example, display information of a warning or alerting nature could be highlighted in red.

Particularly with regard to modern lighting design, depending upon the embodiment of the display window, colored displays can in particular achieve a high emotionality or impact on the viewer. The display window can therefore almost take on the function of a second display level.

According to the invention, a reflector box can be disposed between the display window and the board. This is used for the demarcation of different display information regions. Otherwise, in particular, when there are large distances between display LEDs and the display window, there could be a mutual negative influence of adjacent display information regions. For example, in the case of the above-described representation of the display information by means of a negative inscription, which can also be covered by a diffuse film, without a reflector box, a temporarily non-illuminated region with display information could also be illuminated in an undesirable way by the light energy of the LEDs in an adjacent illuminated region.

The reflector box can comprise a plurality of partitions which extend between the display LEDs and the display window and screen a luminous radiation from an adjacent region. A plurality of opaque partitions in the reflector box can form a lighting well, wherein the partitions represent the side walls of the lighting well. The partitions can also form a frame of which one side lies against the display window and the other against the board bearing the display LEDs. The frame of the reflector box can therefore determine the distance between the board or display LEDs and the display window and fix the location of the board or display LEDs relative to the display window.

In order to be able to position the reflector box accurately between the board bearing the display LEDs and the display window, the reflector box can comprise positioning elements. These elements can ensure the retention of a predefined position of the reflector box relative to the display window and/or the board. In the case of an elastic embodiment of the elements, these may, for example, be supported elastically on the board so that the reflector box fixes itself in a predetermined position relative to the display window when the latter is assembled. In addition, the elastic elements can compensate distance tolerances between the display window and the board.

Numerous variants of the display window can also be achieved by varying the film and/or inscription by geometrically different visual regions of the foreground illumination. For this, the microstructure can only cover regions of the display window. The reflector box can comprise a plurality of lighting wells separating regions of different display information or even regions with display information from others without display information. The side walls of the lighting wells can also be light-conducting. If they are also colored, the regions with display information demarcated by the lighting wells can be represented with optionally colored illuminated frames.

Advantageously, the display window according to the invention can also be combined with LC displays. The display window creates a foreground illumination for the LC cells of the LC displays. Therefore, even the low transmission of approximately 15 to 25% of transflective and transmissive LC cells can remain of no significance since the front side of the LC cells is illuminated. Compared to backlighting, foreground illumination also requires less light energy. In addition, the LC cells can be embodied reflectively in order to facilitate improved contrast properties, particularly with medium to bright ambient light.

The display window according to the invention can, for example, be used in domestic appliances. Domestic appliances are, for example: washing machines, driers, cookers, ovens, microwaves, dishwashers, refrigerators and steam cookers. However, the field of application of the present invention is not restricted to the examples given.

The principle of the invention is explained below in more detail by way of example with reference to diagrams which show:

DESCRIPTION OF THE INVENTION

Figure 1:
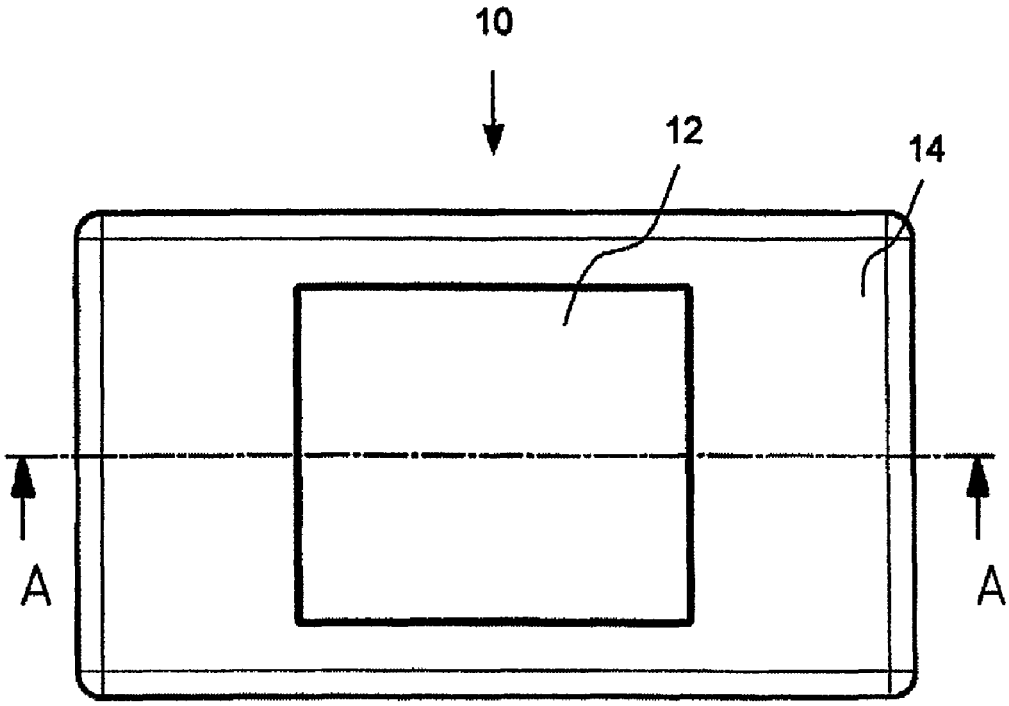
FIG. 1 a schematic representation of an LED (light emitting diode) display with a display window as seen by a viewer.

FIG. 1 shows an LED display unit 10 with a display window 12 and a housing 14 as seen by a viewer. This shows a front side of the display window 12.

The display window 12 is depicted with a rectangular flat front side. The housing 14 completely surrounds the display window 12 in the plane of projection. The front side of the display window 12 forms a flat surface with the housing 14. The housing 14 has a recess with a shape corresponding to the area of the display window 12 visible to the viewer.

Figure 2:
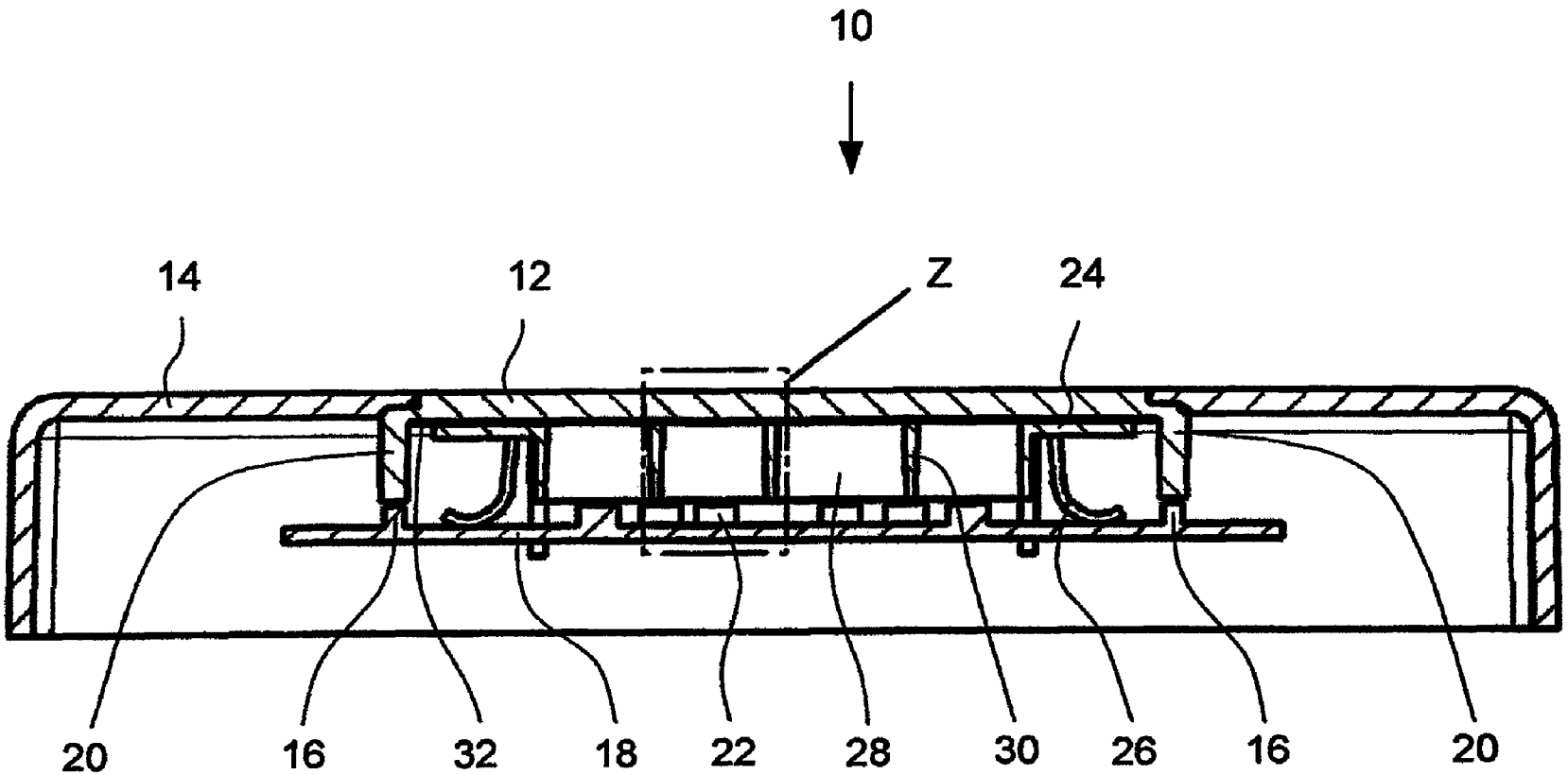
FIG. 2 a sectional representation according to the line of intersection A-A shown in FIG. 1.

FIG. 2 shows the display unit 10 shown in FIG. 1 in section along the line of intersection A-A.

The housing 14 and the display window 12 form a horizontal plane. A board 18 is disposed parallel to this plane and at a distance to the display window 12. SMD LEDs 16 are attached in a marginal region of the board 18. Optical links 20 extend adjacent to these SMD LEDs in their direction of radiation. The light guide paths 20 are embodied as a component of the display window 12 and protrude at right angles from its edge. A plurality of display LEDs 22 are disposed in the central region of the board 18 below the display window 12.

There is also a reflector box 24 between the display window 12 and the board 18. It comprises a plurality of lighting wells 28 which extend from above the display LEDs 22 in the direction of the display window 12. They are adjoined by side walls 30 extending between the display window 12 and the board 18 perpendicularly to the front side of the display window 12.

The display window 12 is illuminated by the SMD LEDs 16. These SMD LEDs 16 are placed on the board 18 to the side of the display LEDs 22. The light energy is relayed from the SMD LEDs 16 to the display window 12 by the optical links 20. These directly adjoin the SMD LEDs 16 or are disposed adjacently to and/or at a distance from the SMD LEDs 16.

The display LEDs 22, which are also LEDs in SMD design, are also disposed on the board 18. The display LEDs 22 reproduce the display information. They emit their light energy in the direction of the display window 12. Hereby, the side walls 30 of the lighting wells 28 divide regions of different display information or regions with and without display information from each other.

The reflector box comprises a plurality of positioning elements 26 in a marginal region. They are embodied elastically so that any positional tolerances that occur, for example in relation to the distance between the board 18 and display window 12, can be compensated. The elastic positioning elements 26 automatically ensure that the reflector box 24 is securely positioned relative to the board 18 and to the display window 12 during the assembly of the display unit 10.

A film 32 is applied between the rear side of the display window 12 and the reflector box 24. It is transparent and diffuse. This makes the display information appear more homogeneous to the viewer even if it is generated by a plurality of individual display LEDs 22.

Figure 3:
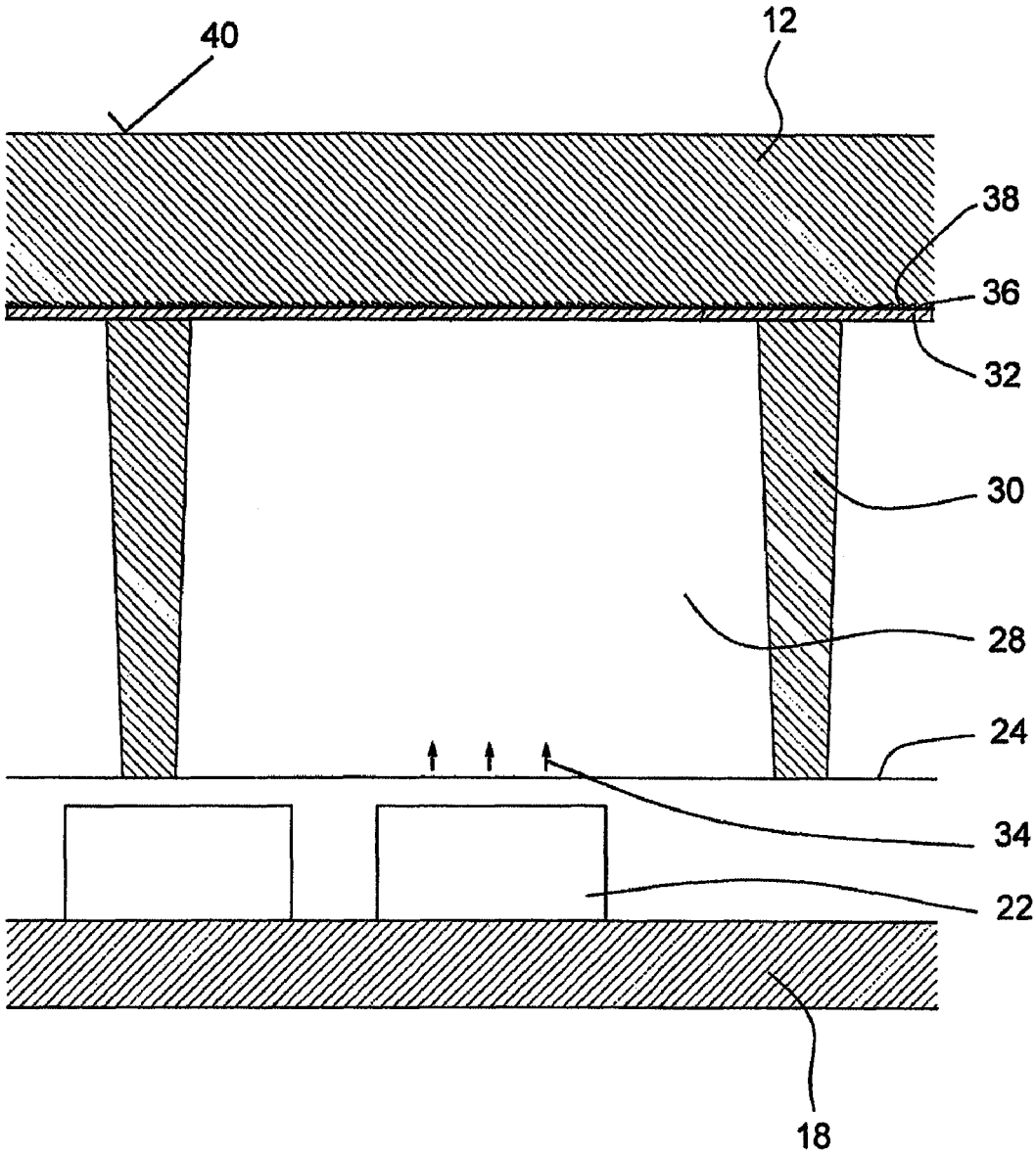
FIG. 3 a schematic representation of the detail Z from FIG. 2.

FIG. 3 shows a enlargement of the detail identified with Z in FIG. 2.

In this enlarged representation, a microstructure 36 comprising a plurality of surfaces 38 disposed on the rear side of the display window 12 can be identified. The surfaces 38 comprise a predefined inclination relative to the front side of the display window 12.

The display LEDs 22 in a display information region disposed on the board 18 emit their light energy 34 through the lighting well 28 in the direction of the display window 12. The display LEDs 22 are also embodied in an SMD design. The display information represented by the display LEDs 22, for example text or symbols, appear through the diffuse film 32 to the viewer of the display window 12 as homogeneous continuous lines and not in the form of a plurality of individual, for example punctiform, light sources.

The surfaces 38 of microstructure 36 are aligned so that the light energy coupled into the display window 12 by the SMD LEDs 16 is reflected perpendicularly upward to the surface 40 of the display window 12.

For a better elucidation of the design of the display unit 10, FIGS. 4 to 7 show individual parts of the display unit 10 in a perspective view. The sequence of FIGS. 4 to 7 can also be considered to be an assembly sequence for the display unit 10.

Figure 4:
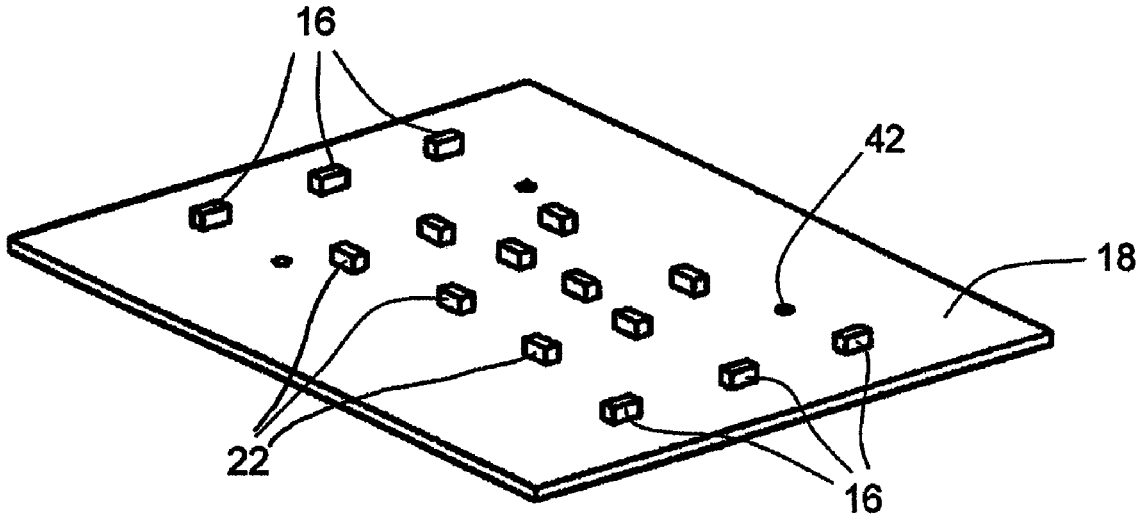
FIG. 4 a schematic representation of a display board with SMD (surface mounted device) LEDs.

FIG. 4 shows the board 18 with nine display LEDs 22 applied in a central region of the board 18. These are used for the representation of display information. In a marginal region of the board 18, three SMD LEDs 16 are disposed in each case to the right and left of the display LEDs 22. They form the basis for the illumination of the display window 12 (not shown in FIG. 4). Positioning aids 42 in the form of recesses are also introduced into the board 18 in order to enable the reflector box 24 to be securely positioned on the board 18.

Figure 5:
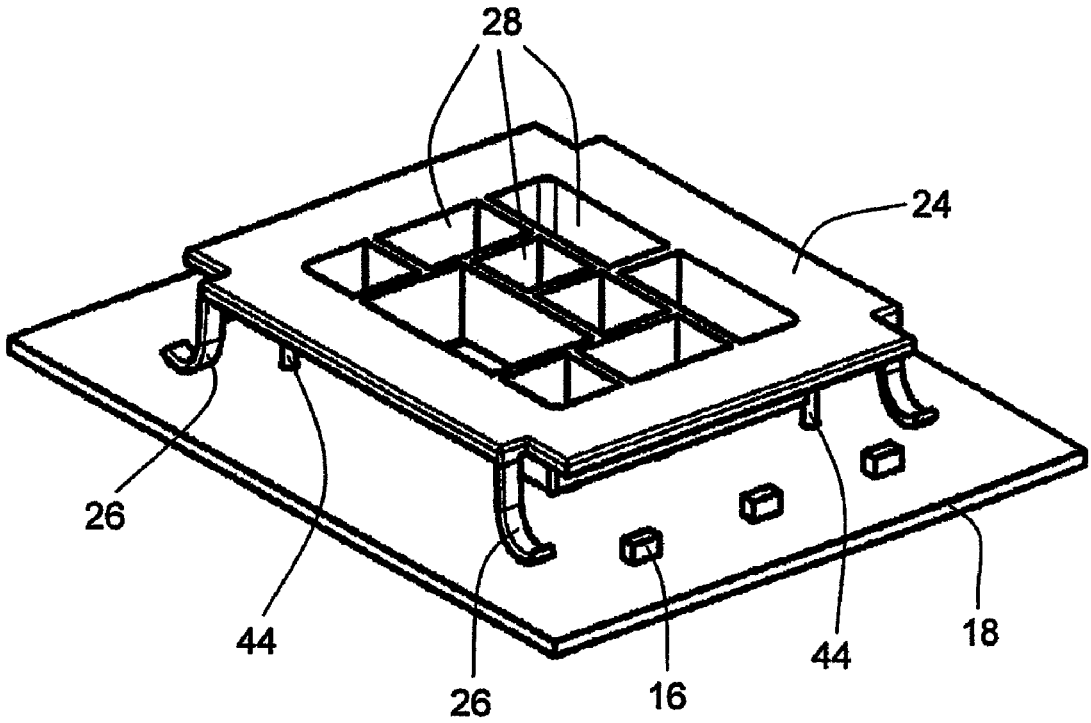
FIG. 5 a schematic representation of a display board with SMD LEDs with a superposed reflector box.

FIG. 5 shows the board 18 shown in FIG. 4 with a superposed reflector box 24. The reflector box 24 comprises projections 44 whose shape and position correspond to the positioning aids 42 of the board 18. When the reflector box 24 is superposed on the board 18, these projections 44 engage in the positioning aids 42 of the board 18 and in this way secure the position of the reflector box 24 relative to the board 18. The necessary distance between the lower edge of the reflector box 24 and the display LEDs 22 or the board 18 is ensured by the positioning elements 26. These are embodied elastically resulting in the automatic alignment and fixing of the reflector box 24 relative to the display window 12 and the board 18.

The reflector box 24 comprises a plurality of lighting wells 28, whose disposition, number, shape and size correspond to those of the display information regions. Disposed around the lighting wells 28, there is a frame which ensures that the reflector box 24 lies securely on the display window 12.

Figure 6:
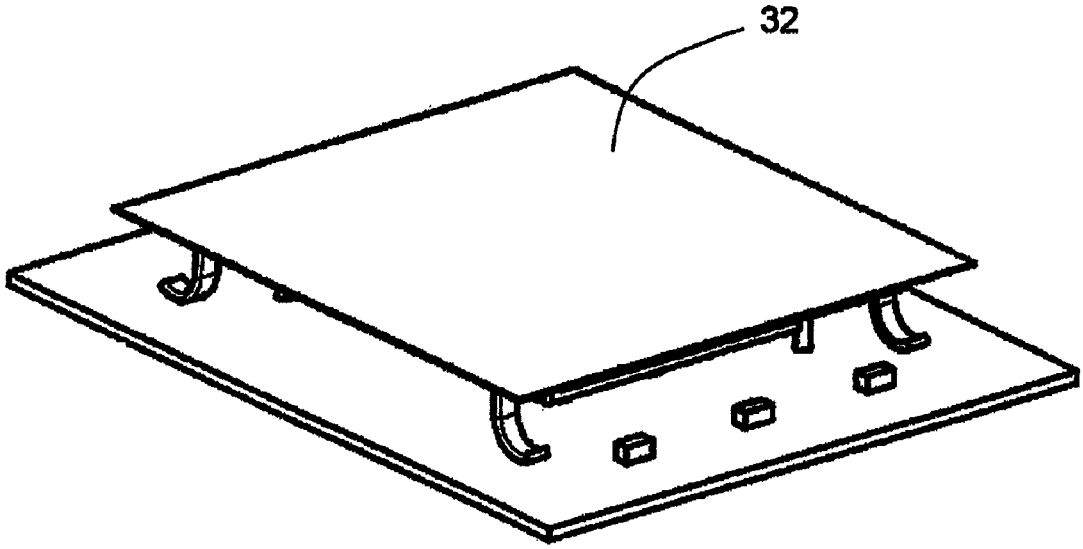
FIG. 6 a schematic representation of a display board with SMD LEDs, superposed reflector box and a film and FIG. 7 a schematic representation of a display board with SMD LEDs, superposed reflector box, film and display window.

FIG. 6 differs from FIG. 5 in that the film 32 is applied to the reflector box 24. For secure positional fixing of the film 32 on the reflector box 24, the film 32 has an adhesive layer, for example a glued layer.

Figure 7:
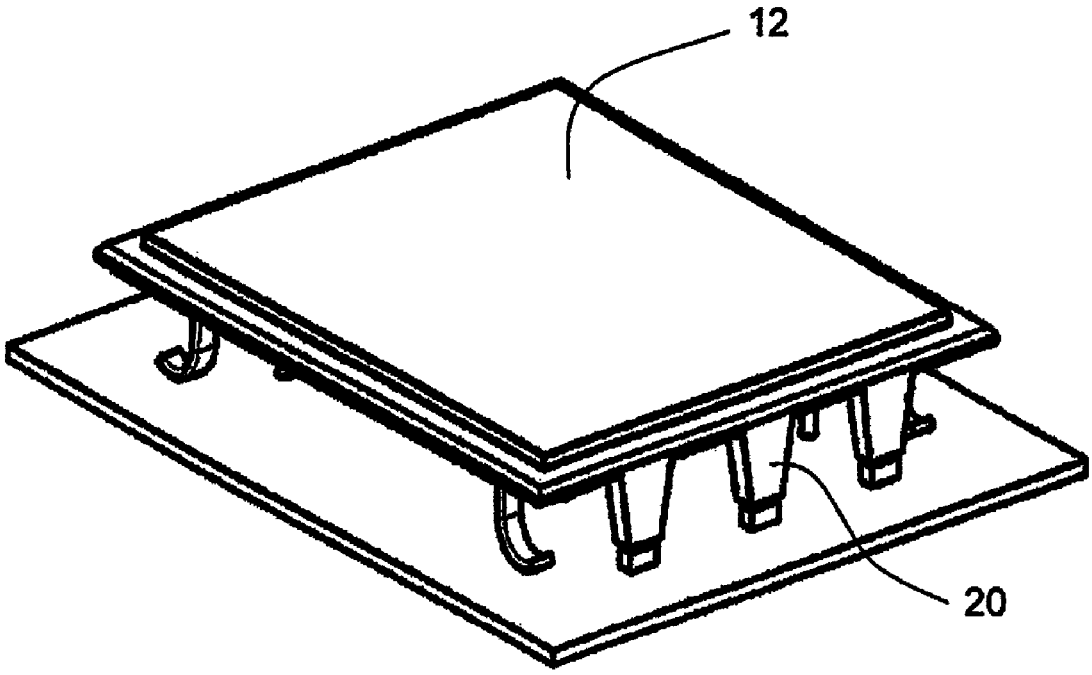

FIG. 7 shows an assembled state of the display unit 10, in which, additionally to the assembled state shown in FIG. 6, the display window 12 with the optical links 20 is superposed on the film 32.

Finally, reference is made once again to the fact that the display unit 10 described in detail above is an exemplary embodiment which can be modified by the person skilled in the art in a wide variety of ways without leaving the scope of the invention. In particular, the specific embodiments of the housing 14 and the display window 12 can differ from the form described here. The reflector box 24 can also be of a different form if necessary for reasons of space or design.

For reasons of completeness, reference is also made to the fact that the use of the indefinite article "a" or "an" does not mean that the features in question cannot be pressure several times.

10 Display unit
12 Display window
14 Housing
16 SMD-LED
18 Board
20 Optical link
22 Display LED
24 Reflector box
26 Positioning element

28 Lighting well
30 Side wall
32 Film
34 Light energy
36 Microstructure
38 Surface of the microstructure 36
40 Surface of the display window 12
42 Positioning aid
44 Projection

The invention claimed is:

1. A display window assembly formed with a display window having a front side facing towards a viewer and a rear side, comprising:

a lighting device for illuminating the display window;

wherein light of said lighting device for illuminating the display window is introduced laterally into the display window;

a display disposed behind the display window and facing towards the rear side of the display window;

a microstructure disposed on the rear side of the display window facing said display, said microstructure covering the display window only in partial areas thereof; and wherein the display window comprises a film or an inscription between the microstructure and the display.

2. The display window assembly according to claim 1, wherein said display is an LED display or an LC display.

3. The display window assembly according to claim 1, wherein said microstructure is formed with surfaces reflecting the light coupled into the display window by said lighting device perpendicular to a surface of the display window.

4. The display window assembly according to claim 3, wherein said surfaces are formed for total reflection of the light from said lighting device, and wherein those areas of the display window through which indications of said display are visible are not formed with said surfaces.

5. The display window assembly according to claim 1, which comprises at least one optical link disposed between the display window and said lighting device.

6. A display window assembly formed with a display window having a front side facing towards a viewer and a rear side, comprising:

a lighting device for illuminating the display window;

wherein light of said lighting device for illuminating the display window is introduced laterally into the display window;

a display disposed behind the display window and facing towards the rear side of the display window;

a microstructure disposed on the rear side of the display window facing said display, said microstructure covering the display window only in partial areas thereof; and wherein the display window carries a diffuse film between the microstructure and the display.

7. A display window assembly formed with a display window having a front side facing towards a viewer and a rear side, comprising:

a lighting device for illuminating the display window;

wherein light of said lighting device for illuminating the display window is introduced laterally into the display window;

a display disposed behind the display window and facing towards the rear side of the display window;

a microstructure disposed on the rear side of the display window facing said display, said microstructure covering the display window only in partial areas thereof; and wherein the display window is colored and comprises a film or inscription between the microstructure and the display.

8. A display window assembly formed with a display window, comprising:

a lighting device for illuminating the display window;

wherein light of said lighting device for illuminating the display window is introduced laterally into the display window;

a display;

a microstructure disposed on a side of the display window facing said display, said microstructure covering the display window only in partial areas thereof;

a reflector box disposed between said display window and said display, said reflector box having at least one lighting well with side walls and elastic positioning elements disposed to fix a position of said reflector box relative to the display window and said display.

9. A domestic appliance with an LED or LC display unit, comprising at least one display window assembly according to claim 1.

10. A domestic appliance with an LED or LC display unit, comprising at least one display window assembly according to claim 6.

11. A domestic appliance with an LED or LC display unit, comprising at least one display window assembly according to claim 7.

12. A domestic appliance with an LED or LC display unit, comprising at least one display window assembly according to claim 8.

* * * * *